US007878848B1

(12) United States Patent
Yang et al.

(10) Patent No.: US 7,878,848 B1
(45) Date of Patent: Feb. 1, 2011

(54) BOARD LOCK WITH A MAIN PLATE WITH A PAIR OF ARMS PENETRATING SLITS FROM TOP TO BOTTOM OF A CONNECTOR HOUSING AND BATTERY CONNECTOR USING THE SAME

(75) Inventors: Chih-Lin Yang, Tu-Cheng (TW); Chin-Chou Wang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/701,562

(22) Filed: Feb. 6, 2010

(51) Int. Cl.
*H01R 13/60* (2006.01)

(52) U.S. Cl. ..... 439/567

(58) Field of Classification Search ..... 439/567, 439/607.01, 565, 552
See application file for complete search history.

(56) References Cited

U.S. PATENT DOCUMENTS 5,334,049 A * 8/1994 Kachlic et al. ..... 439/567
7,063,545 B2 * 6/2006 Zu et al. ..... 439/79
7,108,555 B2 * 9/2006 Mao et al. ..... 439/607.01
2006/0014432 A1 * 1/2006 Mao et al. ..... 439/607

* cited by examiner

*Primary Examiner*—Chandrika Prasad
(74) *Attorney, Agent, or Firm*—Cheng-Ju Chiang

(57) ABSTRACT

A battery connector mounted on a top surface of a printed circuit board defining a pair of penetrating holes, which has a housing, a plurality of contacts secured to the housing and a board lock fixing the battery connector to the printed circuit board. The housing has a pair of penetrating slits penetrating a top surface and a bottom surface thereof. The board lock is formed as one piece and has a main plate mounted on the top surface of the housing, a pair of holding arms bent downward from opposite ends of the main plate and respectively extending through the penetrating slits of the housing and the penetrating holes of the printed circuit board, and a pair of projections protruding outwardly from each of the holding arms and engaged to the periphery of each of the penetrating holes on a bottom surface of the printed circuit board.

14 Claims, 6 Drawing Sheets

BOARD LOCK WITH A MAIN PLATE WITH A PAIR OF ARMS PENETRATING SLITS FROM TOP TO BOTTOM OF A CONNECTOR HOUSING AND BATTERY CONNECTOR USING THE SAME

BACKGROUND OF THE INVENTION

1. Field of the Invention

The present invention relates to a battery connector, more specifically, to a battery connector with a board lock capable of mounting the battery connector on a printed circuit board.

2. The Related Art

Please refer to FIG. 1 and FIG. 2. A conventional battery connector 800 is mounted on a printed circuit board 900. The printed circuit board 900 has a plurality of fixing holes 902 formed on a mounting surface thereof. The battery connector 800 includes an insulating housing 802, a plurality of contacts 804 and plurality of fixing terminals 806.

The insulating housing 802 is formed an elongate shape and transversely mounted on the printed circuit board 900. The insulating housing 802 defines a front surface 808, a rear surface 810 opposite to the front surface 808 and a bottom surface 812 connected to the front surface 808 and the rear surface 810.

The front surface of the insulating housing 802 is vertically formed a plurality of first slots 814. The rear surface 810 of the insulating housing 802 is vertically formed a plurality of second slots 816. Each of the second slots 816 is extended a fixing channel 818 from a top thereof and towards the front surface 808.

Each of the contacts 804 is secured in each of the first slots 814. The bottom edge of the contact 804 and the bottom surface 812 of the insulating housing 802 are at the same plate. Each of the fixing terminals 806 includes a vertical strip 820 and a horizontal fixing strip 822 extending from the top of the vertical strip 820.

The horizontal fixing strip 822 of the fixing terminal 806 is engaged into the fixing channel 818 of the insulating housing 802. The vertical strip 820 is received in the second slot 816 and the tail thereof protrudes the bottom surface 812 of the insulating housing 802.

The battery connector 800 is positioned on the printed circuit board 900 by inserting the tails of the fixing terminals into the fixing holes 902 of the printed circuit board 900 respectively. It is complex to form the second slots 816, provide the fixing terminals 806 and respectively engage each of the fixing terminals 806 into each of the second slots 816.

SUMMARY OF THE INVENTION

An object of the present invention is to provide a battery connector.

According to the invention, the battery connector is mounted on a printed circuit board. The printed circuit board defines a top surface, a bottom surface and a pair of penetrating holes penetrating the top surface and the bottom surface thereof.

The battery connector has a housing, a plurality of contacts and a board lock. The housing is formed of an elongate shape and defines a top surface, a bottom surface, a front surface, a plurality of grooves and a pair of penetrating slits.

The bottom surface of the housing is mounted on top surface of the printed circuit board. The front surface of the housing is vertical with the top surface and the bottom surface of the housing. The grooves are formed on the front surface. The penetrating slits are penetrating the top surface and the bottom surface and vertical with the top surface, the bottom surface and the front surface of the housing.

The contacts are received in the grooves of the housing respectively. The board lock has a main plate, a pair of holding arms and a pair of projections. The main plate is formed of an elongate shape and mounted on the top surface of the insulating housing. The holding arms are bent downward from opposite ends of the main plate and respectively extending through the penetrating slits of the housing and the penetrating holes of the printed circuit board.

The projections are protruding outwardly from each of the holding arms and engaged to the periphery of each of the penetrating holes on the bottom surface of the printed circuit board. The projections and the holding arms are formed at a same plate.

Another object of the present invention is to provide a board lock formed as one piece for engaging a connector to a printed circuit board.

According to the invention, the printed circuit board defines a top surface, a bottom surface and a pair of penetrating holes penetrating the top surface and the bottom surface. The connector has a housing defining a top surface, a bottom surface and a pair of penetrating slits. The bottom surface of the housing is mounted on the top surface of the printed circuit board. The penetrating slits are penetrating the top surface and the bottom surface of the housing.

The board lock has a main plate, a pair of holding arms and a pair of projections. The main plate is formed of an elongate shape and mounted on the top surface of the housing of the connector. The holding arms are extending downward from opposite ends of the main plate and being vertical with the main plate. The holding arms respectively pass through the penetrating slits of the housing of the connector and the penetrating holes of the printed circuit board.

The projections are protruding outward from each of the holding arms and at a same plane with the holding arms. The projections engage to the periphery of each of the penetrating holes on the bottom surface of the printed circuit board.

Accordingly, the board lock is stamped or punched as one piece, it is easy to be manufactured. It is easy to fabricate the board lock and the housing of the battery connector and assemble the battery connector with the printed circuit board.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
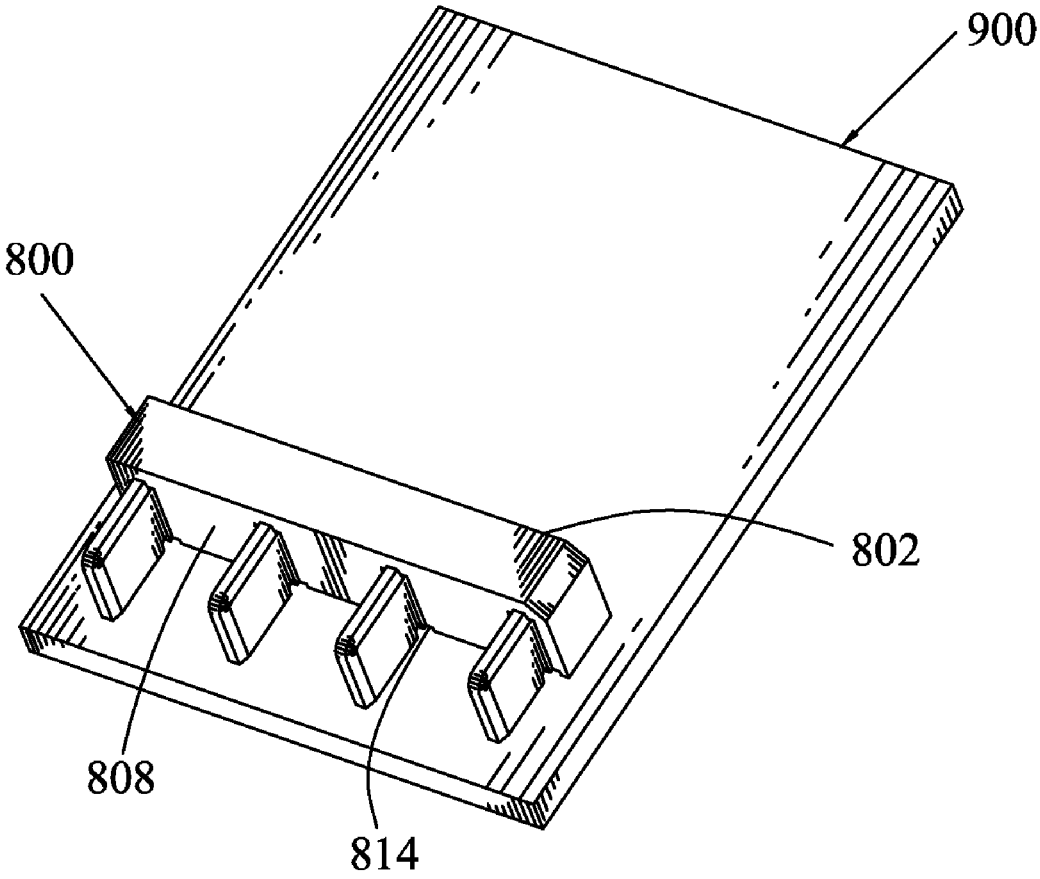
FIG. 1 (Prior Art)
FIG. 1 is a perspective view of a conventional battery connector.
Figure 2:
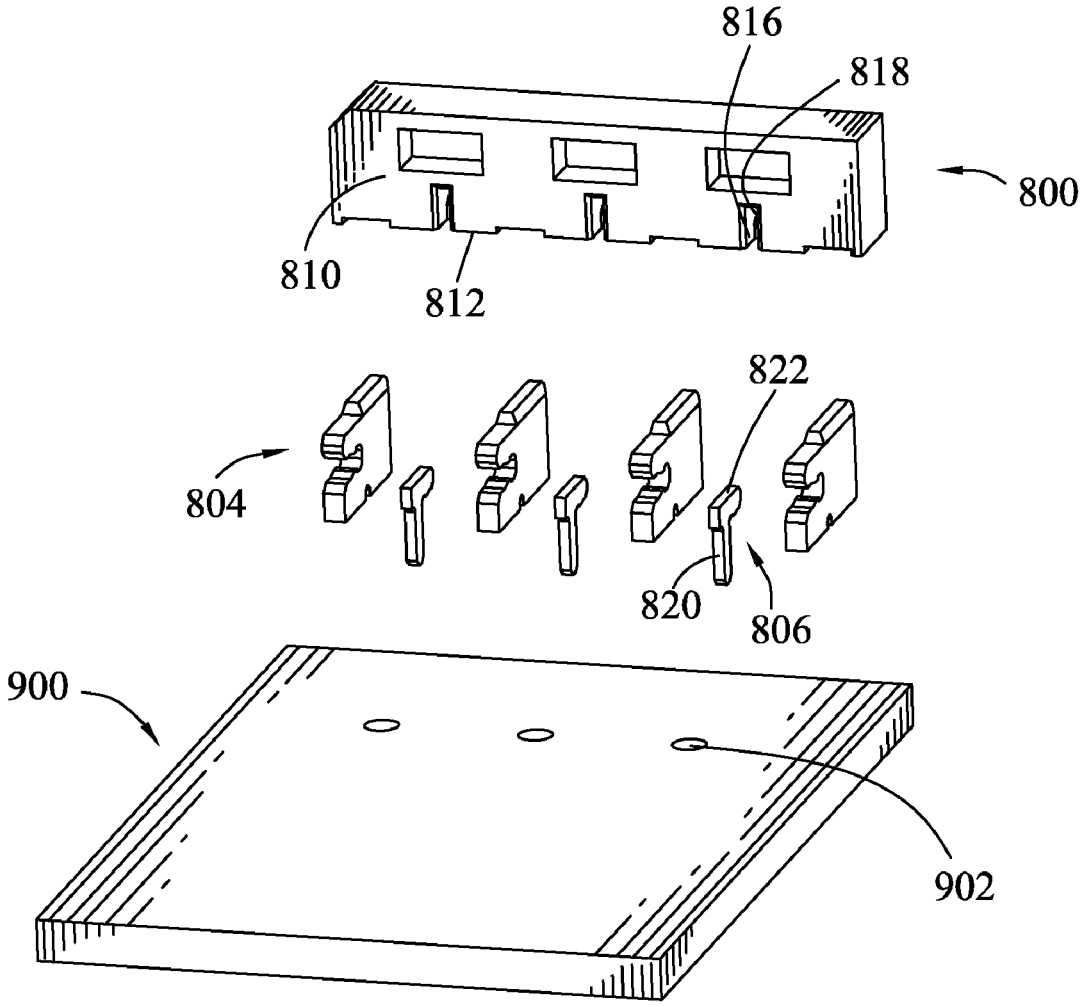
FIG. 2 (Prior Art)
FIG. 2 is an exploded view of the conventional battery connector in FIG. 1.
Figure 3:
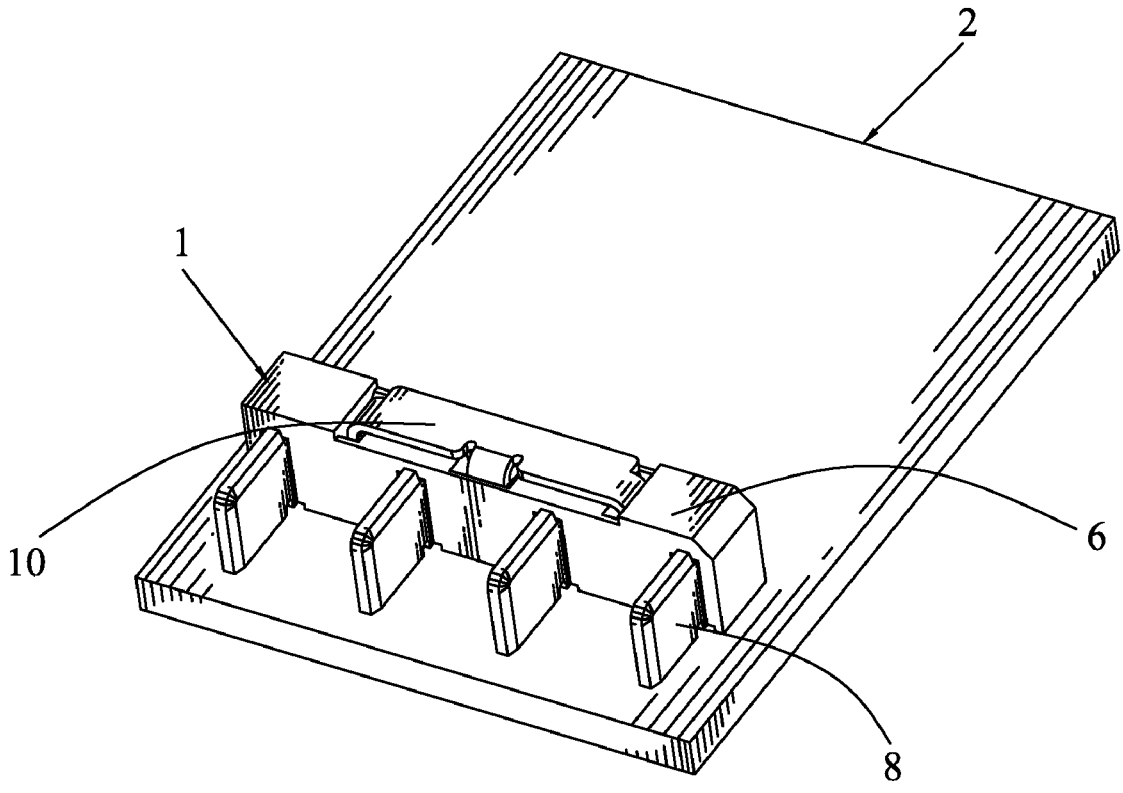
FIG. 3 is a perspective view of a battery connector according to the present invention.
Figure 4:
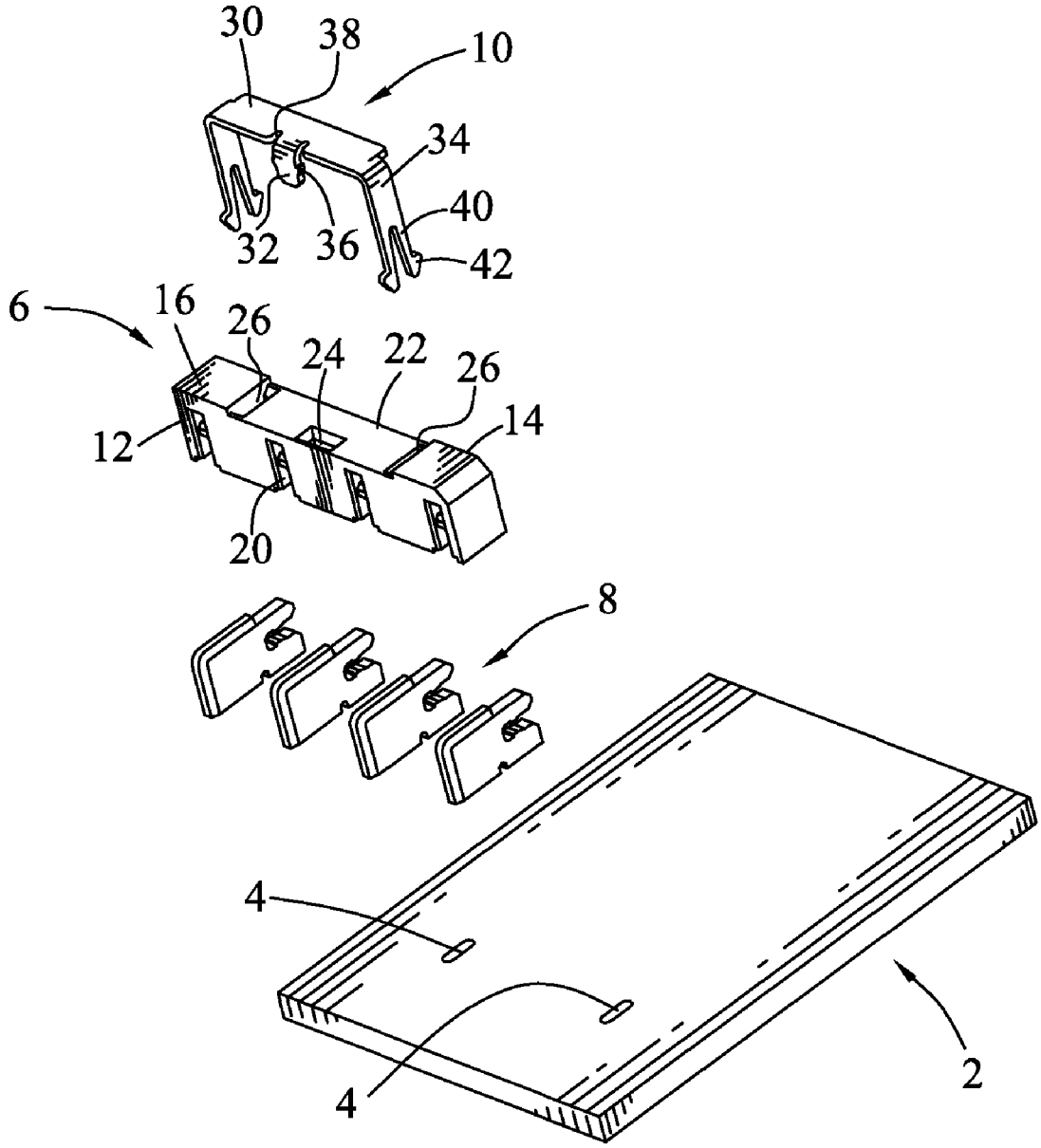
FIG. 4 is an exploded view of the battery connector seen from the top according to the present invention.
Figure 5:
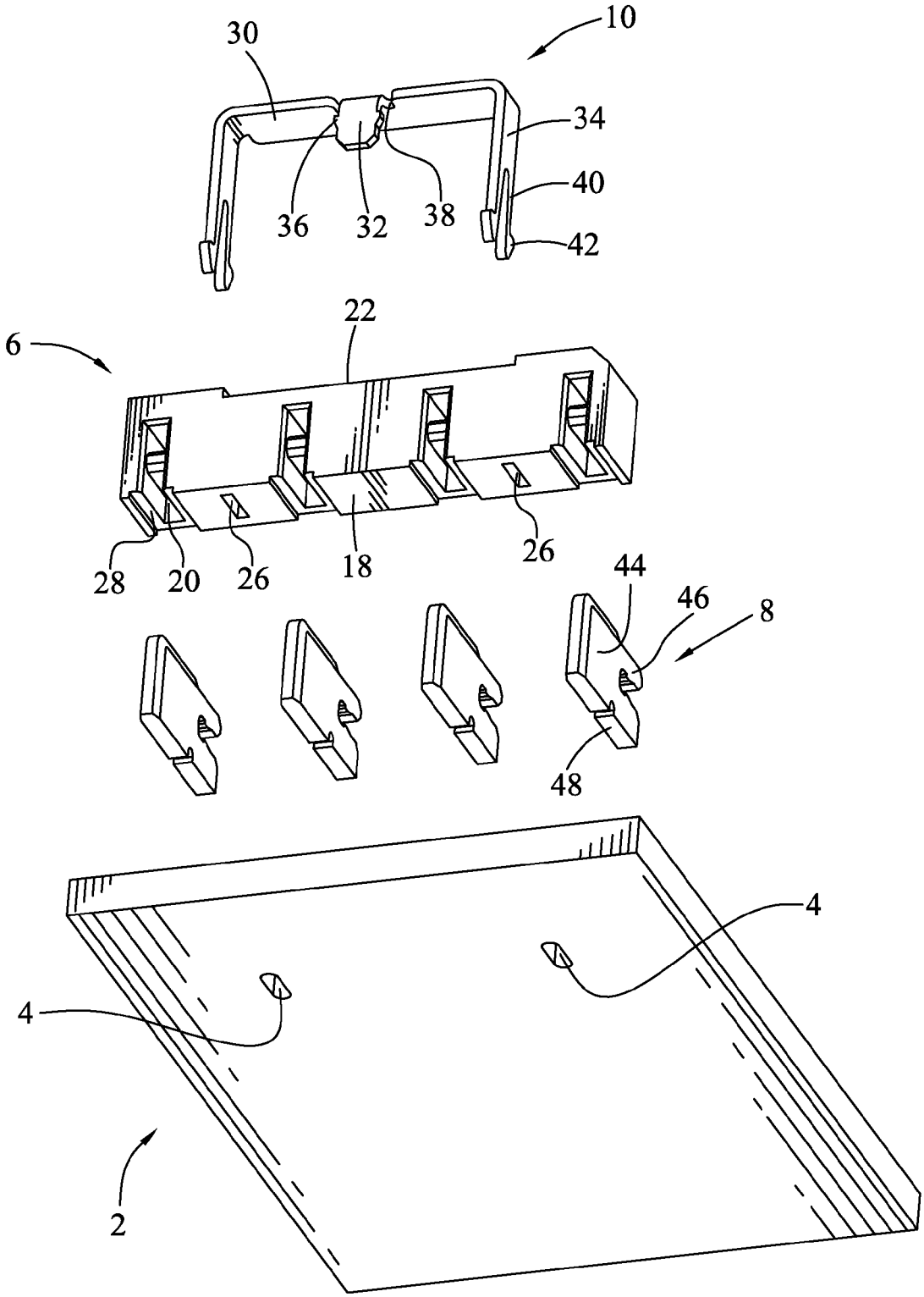
FIG. 5 is an exploded view of the battery connector seen from the bottom according to the present invention.
Figure 6:
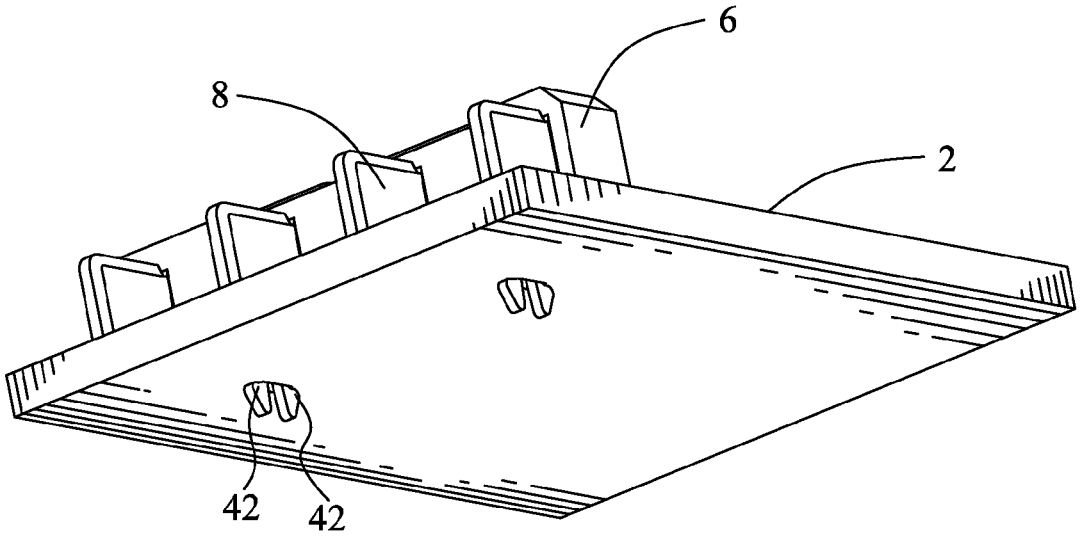
FIG. 6 shows the battery connector mounted on a printed circuit board seen from the bottom.

Please refer to FIG. 3 and FIG. 4. A battery connector 1 according to the present invention is mounted to a printed circuit board 2. The printed circuit board 2 has a pair of penetrating holes 4 penetrating opposite surfaces thereof. The battery connector 1 has an insulating housing 6, a plurality of contacts 8, and a board lock 10.

Please refer to FIG. 3 to FIG. 6. The insulating housing 6 is of an elongate shape and defines a front surface 12, a rear surface 14, a top surface 16 and a bottom surface 18. The insulating housing 6 is transversely mounted on the printed circuit board 2. The front surface 12 of the insulating housing 6 is formed a plurality of vertical grooves 20. One end of each of the grooves 20 penetrates the bottom surface 18 and the other end extends close to the top surface 16.

The top surface 16 of the insulating housing 6 defines a concave portion 22 at the middle portion thereof. The concave portion 22 is formed along a longitudinal direction of the insulating housing 6. Especially, the concave portion 22 is opened at the front surface 12 and the rear surface 14.

The concave portion 22 defines a fixing slit 24 at a middle portion thereof and adjacent to the front surface 12, and a pair of penetrating slits 26 at lateral ends thereof. The fixing slit 24 is parallel with the front surface 12. The penetrating slits 26 is perpendicular to the front surface 12 and vertically penetrating the insulating housing 6 from the concave portion 22 to the bottom surface 18.

The bottom surface 18 of insulating housing 6 defines a plurality of shunned depressions 28. Each of the shunned depressions 28 is aligned with and connected to each of the grooves 20. The width of the shunned depressions 28 is larger than the grooves.

The board lock 10 is made of a metal foil and stamped as one piece. The board lock 10 has a horizontal main plate 30, a vertical fixing tab 32 and a pair of vertical holding arms 34. The main plate 30 is formed as an elongate shape and received in the concave portion 22 of the insulating housing 6. The main plate 30 is parallel with the top surface 16 of the insulating housing 6.

The fixing tab 32 is extending from the front side of the main plate 30 and bent downwardly. The fixing tab 32 is extending in a plane paralleling with the front surface 12 of the insulating housing 6. The side edges of the fixing tab 32 are respectively protruding a barb 36. Each of corners where the fixing tab 32 connects to the main plate 30 is punched as a chink 38 inside the main plate 30.

The holding arms 34 are extending from the lateral ends of the main plate 30 and bent downwardly. The holding arms 34 are extending in a plane vertical to the main plate 30 and the fixing tab 32. Each of the holding arms 34 has a pair of spaced fingers 40 and a pair of projections 42 respectively protruded from the distal end of the fingers 40.

The holding arms 34, the fingers 40 and projections 42 are stamped as one piece and at the same plane. The projections 42 respectively protrude forward and the rearward. Each of the contacts 8 is stamped as one piece and has a contact portion 44, a fixing portion 46 and a soldering portion 48.

If the battery connector 1 is assembled, the fixing portion 46 of the contact 8 will be engaged into the groove 20 of the insulating housing 6. The contact portion 44 of the contact 8 protrudes from the front surface 12 of the insulating housing 6. The soldering portion 48 of the contact 8 and the bottom surface 18 of the insulating housing 6 are at the same plane.

The main plate 30 of the board lock 10 is received in the concave portion 22 of the top surface 16 of the insulating housing 6. The fixing tab 32 is inserted into the fixing slit 24 formed on the concave portion 22 of the top surface 16 of the insulating housing 6. The barbs 36 of the fixing tab 32 abut against the inner surface of the fixing slit 24 for engaging the board lock 10 with the insulating housing 6.

The holding arms 34 are respectively inserted into the penetrating slits 26 formed at the lateral ends of the concave portion 22 of the top surface 16 of the insulating housing 6. The fingers 40 and the projections 42 pass through the penetrating slits 26 and protrude from the bottom surface 18 of the insulating housing 6.

If the battery connector 1 is mounted on the printed circuit board 2, the bottom surface 18 of the insulating housing 6 and the soldering portion 48 of the contacts 8 will be mounted on a top surface of the printed circuit board. The fingers 40 and the projections 42 of the board lock 10 are inserted through the penetrating holes 4 of the printed circuit board 2. The projections 42 protrude from a bottom surface of the printed circuit board 2 and respectively engage the periphery of the penetrating holes 4 at the bottom surface of the printed circuit board 2.

The length of the holding arms 34 is designed substantially equal to the thickness of the insulting housing 6 and the printed circuit board 2 in order to firmly fix the battery connector 1 on the top surface of the printed circuit board. The shunned depressions 28 formed on the bottom surface 18 of the insulating housing 6 prevent the solders on the printed circuit board 2 from being damaged by the bottom surface 18 of the insulating housing 6.

As described above, the board lock 10 is engaged to the insulating housing 6 of the battery connector 1 and fixing the battery connector 1 to the printed circuit board 2. The length of the holding arms 34 of board lock 10 is designed for restricting the battery connector 1 and the printed circuit board 2 between the main plate 30 and projections 42 of the board lock 10. Because the board lock 10 is stamped or punched as one piece, it is easy to be manufactured. It is easy to fabricate the battery connector 1 and assemble the battery connector 1 with the printed circuit board 2.

Furthermore, the present invention is not limited to the embodiments described above; diverse additions, alterations and the like may be made within the scope of the present invention by a person skilled in the art. For example, respective embodiments may be appropriately combined.

What is claimed is:

1. A battery connector mounted on a printed circuit board formed a pair of penetrating holes penetrating a top surface and a bottom surface of the printed circuit board, comprising:

a housing formed of an elongate shape and comprising a top surface, a bottom surface parallel with the top surface and mounted on top surface of the printed circuit board, a front surface being vertical with the top surface and the bottom surface, a plurality of grooves formed on the front surface, and a pair of penetrating slits penetrating the top surface and the bottom surface and being vertical with the top surface, the bottom surface and the front surface of the housing;

a plurality of contacts secured in the grooves respectively; and a board lock comprising a main plate formed of an elongate shape along a longitudinal of the housing and mounted on the top surface of the housing, a pair of holding arms bent downward from opposite ends of the main plate and respectively extending through the penetrating slits of the housing and the penetrating holes of the printed circuit board, and a pair of projections protruding outwardly from each of the holding arms and engaged to the periphery of each of the penetrating holes on the bottom surface of the printed circuit board, the projections and the holding arms formed at a same plate.

2. The battery connector as claimed in claim 1, wherein the top surface of the housing defines a fixing slit paralleling with the front surface, the board lock is extending a fixing tab from the main plate, the fixing tab is bent downward and engaged into the fixing slot of the housing.

3. The battery connector as claimed in claim 2, wherein each of the holding arms comprises a pair of spaced fingers, each of the projections protrudes from the distal end of each of the fingers.

4. The battery connector as claimed in claim 3, wherein the fixing tab of the board lock protrudes a pair of barbs engaged with an inner surface of the fixing slit of the housing.

5. The battery connector as claimed in claim 4, wherein each of corners where the fixing tab connects to the main plate is punched a chink inside the main plate.

6. The battery connector as claimed in claim 5, wherein the top surface of the hosing is formed an elongate concave portion along the longitudinal direction for receiving the main plate of the board lock.

7. The battery connector as claimed in claim 6, wherein the fixing slit is formed at a middle portion of the concave portion, the penetrating slits are formed at opposite ends of the concave portion.

8. The battery connector as claimed in claim 7, wherein the grooves open on the bottom surface of the housing, the bottom surface of the housing defines a plurality of shunned depressions of which the width is larger than the grooves, each of the shunned depressions aligned with and connected to each of the grooves.

9. A board lock formed as one piece for engaging a connector to a printed circuit board defining a pair of penetrating holes penetrating a top surface and a bottom surface thereof, the connector having a housing defining a top surface, a bottom surface mounted on the top surface of the printed circuit board, and a pair of penetrating slits penetrating the top surface and the bottom surface of the housing, the board lock comprising:

a main plate formed of an elongate shape and mounted on the top surface of the housing of the connector;

a pair of holding arms extending downward from opposite ends of the main plate and being vertical with the main plate, the holding arms respectively passing through the penetrating slits of the housing of the connector and the penetrating holes of the printed circuit board; and a pair of projections protruding outward from each of the holding arms and at a same plane with the holding arms, the projections engaged to the periphery of each of the penetrating holes at the bottom surface of the printed circuit board.

10. The board lock as claimed in claim 9, wherein the main plate extends a fixing tab downward for being inserted into a fixing slot formed at the top surface of the housing of the connector, the fixing tab is vertical with the main plate and the holding arms.

11. The board lock as claimed in claim 10, wherein each of the holding arms comprises a pair of spaced fingers, each of the projections protrudes from the distal end of each of the fingers.

12. The board lock as claimed in claim 11, wherein the fixing tab protrudes a pair of barbs engaged with an inner surface of the fixing slit of the housing of the connector.

13. The board lock as claimed in claim 12, wherein each of corners where the fixing tab connects to the main plate is punched a chink inside the main plate.

14. The board lock as claimed in claim 13, wherein the fixing tab is extending from a middle portion of a front edge of the main plate.

* * * * *